US009848710B2

(12) United States Patent
Choi

(10) Patent No.: US 9,848,710 B2
(45) Date of Patent: Dec. 26, 2017

(54) FOLDABLE BED FRAME WITH VERTICAL AND CROSSED BARS AND BED HAVING SAME

(71) Applicant: Campvalley (Xiamen) Co., Ltd., Xiamen (CN)

(72) Inventor: Kwan Jun Choi, Xiamen (CN)

(73) Assignee: Campvalley (Xiamen) Co., Ltd., Xiamen (CN)

( * ) Notice: Subject to any disclaimer, the term of this patent is extended or adjusted under 35 U.S.C. 154(b) by 0 days.

(21) Appl. No.: 15/488,323

(22) Filed: Apr. 14, 2017

(65) Prior Publication Data

US 2017/0295940 A1 Oct. 19, 2017

(30) Foreign Application Priority Data

Apr. 15, 2016 (CN) ..... 2016 2 0314845 U

(51) Int. Cl.
*A47C 17/64* (2006.01)
*A47C 17/70* (2006.01)
*A47C 17/72* (2006.01)

(52) U.S. Cl.
CPC ..... *A47C 17/72* (2013.01); *A47C 17/70* (2013.01); *A47C 17/64* (2013.01)

(58) Field of Classification Search
CPC ..... A47C 17/64; A47C 17/645; A47C 17/70; A47C 17/72; A47C 17/82; A47C 19/00; A47C 19/005; A47C 19/12; A47C 19/122; A47C 19/126; A47C 19/14; A47C 19/02; A47C 19/021; A47C 19/024; A47C 19/025; A47C 19/04
USPC ..... 5/110–117, 174, 176.1, 200.1, 201, 202, 5/310, 312, 316
See application file for complete search history.

(56) References Cited

U.S. PATENT DOCUMENTS 37,153 A * 12/1862 Cross ..... A47C 19/14 5/115
228,920 A * 6/1880 Murray et al. ..... A47C 19/14 5/115
242,197 A * 5/1881 Griffith ..... A47C 19/126 5/117
327,055 A * 9/1885 Baker ..... A47C 19/14 5/115
729,486 A * 5/1903 Cantor ..... A47C 19/126 5/117
893,364 A 7/1908 Piaser
(Continued)

FOREIGN PATENT DOCUMENTS

CN 2902036 Y 5/2007
CN 201067222 Y 6/2008
(Continued)

*Primary Examiner* — Robert G. Santos
(74) *Attorney, Agent, or Firm* — Morgan, Lewis & Bockius LLP

(57) ABSTRACT

Disclosed are foldable bed frames and beds. A foldable bed frame includes longitudinal bars, supporting assemblies to support the longitudinal bars, and links to couple one or more supporting assemblies with the longitudinal bars. Each supporting assembly includes vertical and crossed bars. When the beds are unfolded and in use, the vertical bars support the longitudinal bars and bear majority of the load. As such, the bed frames and beds are stable and safe to use.

21 Claims, 12 Drawing Sheets

(56) References Cited

U.S. PATENT DOCUMENTS 1,167,123 A * 1/1916 Sinclair ..... A47C 17/68 105/177
1,263,509 A 4/1918 Zendt
1,330,901 A * 2/1920 Richards ..... A47C 19/126 5/115
1,409,380 A * 3/1922 Irwin et al. ..... A47C 17/68 403/62
1,483,979 A * 2/1924 Lery ..... A47C 19/126 16/366
1,549,934 A * 8/1925 Vanek et al. ..... A47C 17/16 297/377
1,624,965 A * 4/1927 Moore ..... A47C 19/122 5/114
1,694,420 A * 12/1928 Joselowitz ..... A47C 19/122 5/112
1,813,019 A * 7/1931 Brown ..... A47C 19/126 5/112
1,818,036 A * 8/1931 Brown ..... A47C 19/126 5/112
2,121,100 A 6/1938 Rosenbaum
2,616,098 A 11/1952 Love
3,886,606 A 6/1975 Bradford
3,918,109 A 11/1975 Barraclough
3,967,330 A * 7/1976 Zawadowsky ..... A47C 19/122 5/111
4,034,518 A 7/1977 Trecker
4,393,529 A 7/1983 Britz
4,801,176 A 1/1989 Wolberg
4,846,204 A * 7/1989 Sok Kyu ..... E04H 15/324 135/145
5,023,968 A 6/1991 Diehl
5,950,259 A 9/1999 Boggs
6,446,282 B1 * 9/2002 Wu ..... A47C 17/645 5/115
6,457,192 B2 * 10/2002 Choi ..... A47C 4/286 5/112
6,470,517 B1 10/2002 Kang
6,564,402 B1 * 5/2003 Lin ..... A47C 17/645 24/72.5
6,711,761 B2 * 3/2004 Choi ..... A47C 4/286 5/112
6,925,664 B1 * 8/2005 Twigg ..... A01K 1/034 5/112
7,100,221 B1 * 9/2006 Twigg ..... A01K 1/034 5/110
7,114,205 B2 * 10/2006 Choi ..... A47C 4/286 5/112
7,509,695 B2 * 3/2009 Zheng ..... A47C 17/68 273/108
7,600,278 B2 * 10/2009 Oh ..... A47C 19/04 5/174
7,648,196 B2 * 1/2010 Degelman ..... A47C 4/286 297/184.1
7,712,163 B2 * 5/2010 Flannery ..... A47C 17/72 5/110
7,721,366 B2 * 5/2010 Lee ..... A47C 19/04 5/201
7,740,108 B2 * 6/2010 Adkins ..... B25H 1/04 182/153
7,757,314 B2 * 7/2010 Yul ..... A47C 19/126 5/110
7,950,083 B2 * 5/2011 Flannery ..... A47C 17/72 5/110
7,971,289 B2 * 7/2011 Payne ..... A47C 7/66 5/2.1
8,056,159 B2 * 11/2011 Lee ..... A47C 19/04 5/200.1
8,245,332 B2 * 8/2012 Yul ..... A47C 17/16 5/111
8,256,042 B2 * 9/2012 Yul ..... A47C 17/72 5/110
8,316,485 B2 * 11/2012 Lee ..... A47C 19/04 5/201
8,393,023 B2 * 3/2013 Choi ..... A47C 19/126 5/111
8,585,135 B2 11/2013 Wilson
8,959,677 B2 * 2/2015 Yul ..... A47C 17/64 5/110
9,107,509 B2 * 8/2015 Lee ..... A47C 19/022
9,131,778 B2 * 9/2015 Jin ..... A47C 17/72
2001/0054198 A1 * 12/2001 Choi ..... A47C 4/286 5/114
2003/0019033 A1 * 1/2003 Choi ..... A47C 4/286 5/114
2004/0000009 A1 * 1/2004 Choi ..... A47C 4/286 5/174
2007/0246300 A1 * 10/2007 Adkins ..... B25H 1/04 182/153
2008/0127413 A1 * 6/2008 Flannery ..... A47C 17/72 5/111
2008/0196162 A1 * 8/2008 Yul ..... A47C 19/14 5/97
2008/0214332 A1 * 9/2008 Zheng ..... A47C 17/68 473/476
2008/0216230 A1 * 9/2008 Yul ..... A47C 17/64 5/12.2
2008/0295246 A1 * 12/2008 Yul ..... A47C 17/16 5/12.2
2009/0064415 A1 * 3/2009 Payne ..... A47C 7/66 5/620
2009/0100597 A1 * 4/2009 Oh ..... A47C 19/04 5/176.1
2009/0140556 A1 * 6/2009 Degelman ..... A47C 4/286 297/16.2
2009/0193583 A1 * 8/2009 Lee ..... A47C 19/04 5/176.1
2009/0249546 A1 * 10/2009 Yul ..... A47C 17/72 5/115
2010/0138994 A1 * 6/2010 Lee ..... A47C 19/022 5/400
2010/0146910 A1 * 6/2010 Lee ..... A47C 19/04 53/473
2010/0223723 A1 * 9/2010 Flannery ..... A47C 17/72 5/111
2010/0293714 A1 * 11/2010 Choi ..... A47C 19/126 5/112
2011/0099712 A1 * 5/2011 Jin ..... A47C 19/122 5/174
2011/0308012 A1 * 12/2011 Jin ..... A47C 19/126 5/110
2012/0017370 A1 * 1/2012 Lee ..... A47C 19/04 5/400
2012/0317717 A1 * 12/2012 Jin ..... A47C 17/72 5/110
2015/0250325 A1 * 9/2015 Lee ..... A47C 19/12 5/202
2015/0313368 A1 * 11/2015 Lee ..... A47C 19/022 29/401.1
2015/0327684 A1 * 11/2015 Lee ..... A47C 19/025 5/200.1

FOREIGN PATENT DOCUMENTS

CN 201767523 U 3/2011
CN 102599755 A 7/2012
CN 203153120 U 8/2013
CN 203153128 U 8/2013
JP 6-197824 A 7/1994

* cited by examiner

FOLDABLE BED FRAME WITH VERTICAL AND CROSSED BARS AND BED HAVING SAME

CROSS-REFERENCE TO RELATED APPLICATIONS

The present application claims priority to Chinese Utility Model Application CN 201620314845 filed Apr. 15, 2016. The disclosure of the application is incorporated herein for all purposes by reference in its entirety.

FIELD OF THE INVENTION

The present invention generally relates to bed frames and beds, and more particularly, relates to bed frames with vertical and crossed bars and beds having such bed frames.

BACKGROUND

Foldable beds are suitable not only for use at homes but also for outdoor activities such as camping. There are a variety of foldable bed frames and beds in the market. Some of existing bed frames include longitudinal bars and crossed bars disposed under the longitudinal bars. Examples of such bed frames are disclosed in Chinese utility model applications CN 200620055538.3 and CN 201020226725.X, the disclosure of each application is incorporated herein for all purposes by reference in its entirety.

In many cases, the crossed bars are relied upon to bear the load or majority of the load when the beds are in use. As such, the intersections (e.g., pivotal connection points) of the crossed bars often get damaged or broken, making the beds unstable. In some cases, the beds may collapse and are not safe to use.

Given the current state of the art, there remains a need for bed frames and beds that address the abovementioned issues.

The information disclosed in this Background section is provided for an understanding of the general background of the invention and is not an acknowledgement or suggestion that this information forms part of the prior art already known to a person skilled in the art.

SUMMARY OF THE INVENTION

The present invention provides foldable bed frames and beds that are stable, safe to use and easy to fold and unfold.

In various exemplary embodiments, the present invention provides a foldable bed frame including left and right longitudinal bars, front, middle and rear supporting assemblies, left and right front links, and left and right rear links. The left and right longitudinal bars are disposed respectively at a left side and a right side of the foldable bed frame when the foldable bed frame is unfolded. Each of the left and right longitudinal bars includes first and second longitudinal bars pivotally connected to each other at their adjacent end portions.

The front, middle and rear supporting assemblies are disposed respectively at a front portion, a middle portion and a rear portion of the foldable bed frame and support the left and right longitudinal bars when the foldable bed frame is unfolded. Each of the front, middle and rear supporting assemblies includes left and right vertical bars, a crossed bar pair, and left and right bases.

The left vertical bar has an upper end portion and a lower end portion, with the upper end portion pivotally connected to the left longitudinal bar at a front portion, a middle portion, or a rear portion of the left longitudinal bar. The right vertical bar has an upper end portion and a lower end portion, with the upper end portion pivotally connected to the right longitudinal bar at a front portion, a middle portion, or a rear portion of the right longitudinal bar.

The crossed bar pair includes a first crossed bar and a second crossed bar pivotally connected to each other at their middle portions. Each of the first and second crossed bars has an upper end portion and a lower end portion. The upper end portion of the first crossed bar is pivotally connected to the upper end portion of the left vertical bar or pivotally connected to the left longitudinal bar at the front portion, the middle portion, or the rear portion of the left longitudinal bar. The upper end portion of the second crossed bar is pivotally connected to the upper end portion of the right vertical bar or pivotally connected to the right longitudinal bar at the front portion, the middle portion, or the rear portion of the right longitudinal bar.

The left base is coupled to the lower end portion of the left vertical bar and the lower end portion of the second crossed bar, and the right base is coupled to the lower end portion of the right vertical bar and the lower end portion of the first crossed bar, when the foldable bed frame is unfolded.

Each of the left and right front links has an upper end portion and a lower end portion. The upper end portion of the left or right front link is pivotally connected to the first longitudinal bar of the left or right longitudinal bar, and the lower end portion of the left or right front link is pivotally connected to the left or right base of the front supporting assembly. Each of the left and right rear links has an upper end portion and a lower end portion. The upper end portion of the left or right rear link is pivotally connected to the second longitudinal bar of the left or right longitudinal bar, and the lower end portion of the left or right rear link is pivotally connected to the left or right base of the rear supporting assembly.

In some exemplary embodiments, of a respective supporting assembly in one or more of the front, middle and rear supporting assemblies, the left or right base includes a first slot and a second slot. In an exemplary embodiment, the left or right vertical bar is fixedly coupled to the first slot, and the first or second crossed bar is removably coupled to the second slot. In an exemplary embodiment, the left or right base includes a first slot and a second slot, the left or right vertical bar is removably coupled to the first slot, and the first or second crossed bar is fixedly coupled to the second slot.

In some exemplary embodiments, of a respective base in the left and right bases of the front and rear supporting assemblies, a bracket is coupled to the respective base or the respective base is formed with a third slot. In such embodiments, the link corresponding to the respective base is pivotally connected to the bracket or the third slot. In an exemplary embodiment, the bracket is fixedly or pivotally coupled to the respective base.

In many exemplary embodiments, a respective supporting assembly in one or more of the front, middle and rear supporting assemblies further includes one or more guides. Each guide has a first end portion pivotally connected to the lower end portion of the left or right vertical bar of the respective supporting assembly, and a second end portion pivotally connected to a lower middle portion of the first or second crossed bar of the respective supporting assembly. In some exemplary embodiments, a respective guide in the one or more guides includes a first guiding piece and a second guiding piece disposed respectively on a front side and a rear side of the respective supporting assembly when the foldable bed frame is unfolded. Each of the first and second guiding pieces has a first end portion pivotally connected to the lower end portion of the left or right vertical bar of the respective supporting assembly, and a second end portion pivotally connected to a lower middle portion of the first or second crossed bar of the respective supporting assembly.

In some exemplary embodiments, the foldable bed frame further includes left and right front guides. Each of the left and right front guides has a first end portion pivotally connected to the lower end portion of the left or right vertical bar of the front supporting assembly and a second end portion pivotally connected to a middle portion of the left or right front link.

In some exemplary embodiments, the foldable bed frame further includes left and right rear guides. Each of the left and right rear guides has a first end portion pivotally connected to the lower end portion of the left or right vertical bar of the rear supporting assembly and a second end portion pivotally connected to a middle portion of the left or right rear link.

In an exemplary embodiment, the foldable bed frame further includes left and right front guides, and left and right rear guides. Each of the left and right front guides has a first end portion pivotally connected to the lower end portion of the left or right vertical bar of the front supporting assembly and a second end portion pivotally connected to a middle portion of the left or right front link. Each of the left and right rear guides has a first end portion pivotally connected to the lower end portion of the left or right vertical bar of the rear supporting assembly and a second end portion pivotally connected to a middle portion of the left or right rear link. In such an embodiment, the middle supporting assembly further includes one or more guides. A respective guide in the one or more guides includes a first guiding piece and a second guiding piece disposed respectively on a front side and a rear side of the respective supporting assembly when the foldable bed frame is unfolded. Each of the first and second guiding pieces has a first end portion pivotally connected to the lower end portion of the left or right vertical bar of the respective supporting assembly, and a second end portion pivotally connected to a lower middle portion of the first or second crossed bar of the respective supporting assembly.

In many exemplary embodiments, the foldable bed frame further includes left and right connectors. The left connector pivotally connects the adjacent end portions of the first and second longitudinal bars of the left longitudinal bar, and the right connector pivotally connects the adjacent end portions of the first and second longitudinal bars of the right longitudinal bar.

In various exemplary embodiments, the present invention provides a foldable bed including a bedding and a foldable bed frame of the present invention disclosed herein to support the bedding.

The foldable bed frames and beds of the present invention have other features and advantages that will be apparent from, or are set forth in more detail in, the accompanying drawings, which are incorporated herein, and the following Detailed Description, which together serve to explain certain principles of exemplary embodiments of the present invention.

BRIEF DESCRIPTION OF THE DRAWINGS

The accompanying drawings, which are incorporated into and constitute a part of this specification, illustrate one or more exemplary embodiments of the present invention and, together with the Detailed Description, serve to explain the principles and implementations of exemplary embodiments of the invention.

DETAILED DESCRIPTION

Reference will now be made in detail to implementations of exemplary embodiments of the present invention as illustrated in the accompanying drawings. The same reference indicators will be used throughout the drawings and the following detailed description to refer to the same or like parts. Those of ordinary skill in the art will understand that the following detailed description is illustrative only and is not intended to be in any way limiting. Other embodiments of the present invention will readily suggest themselves to such skilled persons having benefit of this disclosure.

In the interest of clarity, not all of the routine features of the implementations described herein are shown and described. It will be appreciated that, in the development of any such actual implementation, numerous implementation-specific decisions are made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Many modifications and variations of the exemplary embodiments set forth in this disclosure can be made without departing from the spirit and scope of the embodiments, as will be apparent to those skilled in the art. The specific exemplary embodiments described herein are offered by way of example only, and the disclosure is to be limited only by the terms of the appended claims, along with the full scope of equivalents to which such claims are entitled.

Embodiments of the present invention are described in the context of bed frames and beds. The bed frames and beds can be of various sizes including but not limited to twin, full, queen and king sizes, and of various shapes including but not limited to rectangles and squares. Also, the bed frames can be made of various materials including but not limited to metals such as iron and steel, plastics and woods. In most cases, the bed frames of the present invention can be used alone by placing them on a floor or a ground.

Generally, a bed frame of the present invention includes longitudinal bars, a plurality of supporting assemblies and a plurality of links. The plurality of supporting assemblies is coupled to the longitudinal bars, and supports the longitudinal bars when the bed frame is unfolded and in use. The plurality of links couples one or more supporting assemblies with longitudinal bars, and makes it easy to fold and unfold the bed frame.

Figure 1:
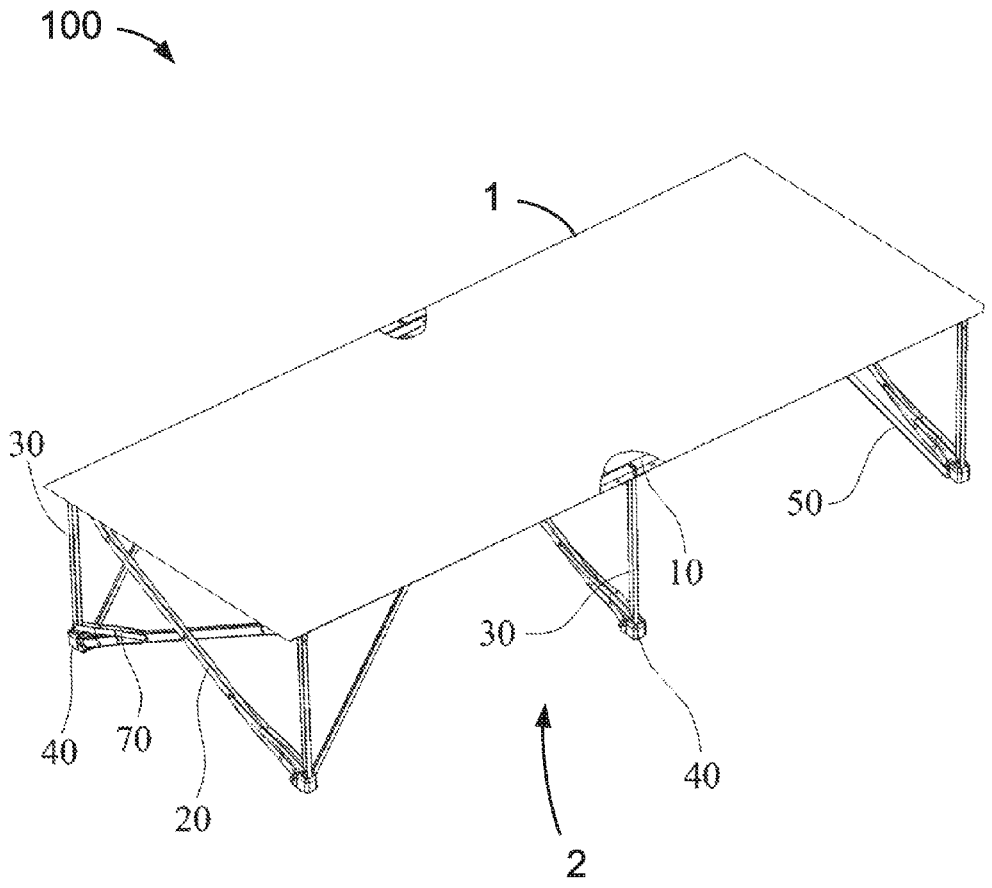
FIG. 1 is a schematic view illustrating an exemplary foldable bed in an unfolded state in accordance with some exemplary embodiments of the present invention.

Referring now to FIG. 1, there is depicted an exemplary foldable bed in accordance with some exemplary embodiments of the present invention. As shown, the exemplary foldable bed includes a bedding such as bedding 1 and a foldable bed frame such as foldable bed frame 2 (e.g., 2*a*, 2*b*, 2*c* or 2*d*). When unfolded and in use, bedding 1 is coupled to and supported by foldable bed frame 2.

Figure 2A:
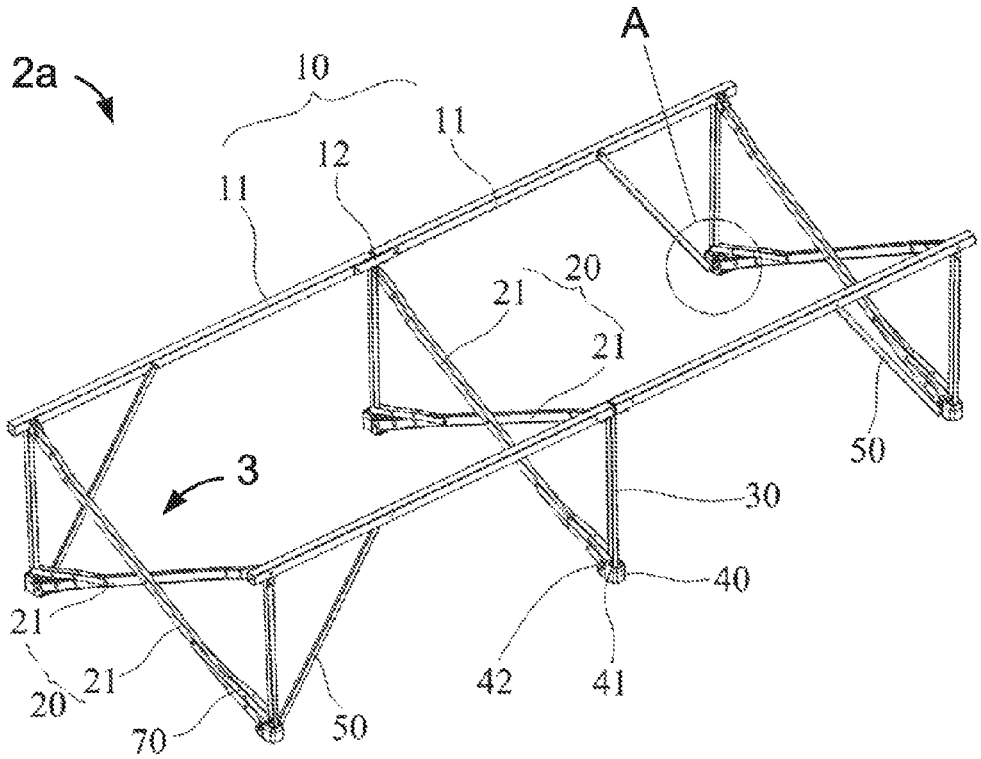
FIG. 2A is a schematic view illustrating an exemplary foldable bed frame in an unfolded state in accordance with some exemplary embodiments of the present invention.
Figure 2B:
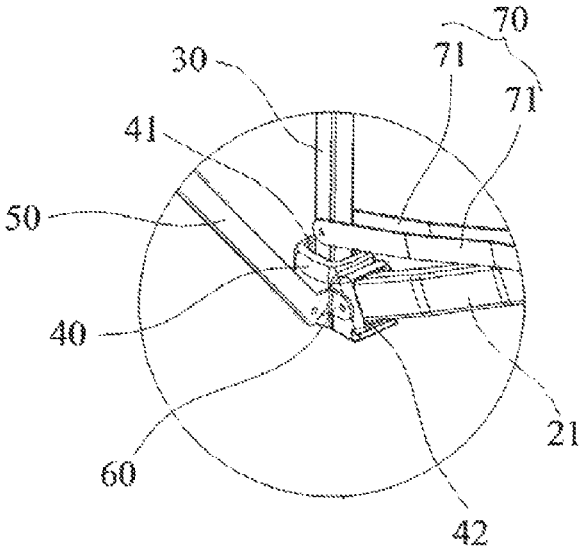
FIG. 2B is a partially enlarged view taken along circle A of FIG. 2A.

Referring to FIGS. 2A and 2B, there is depicted an exemplary foldable bed frame in accordance with some exemplary embodiments of the present invention. As shown, exemplary foldable bed frame 2*a* includes left and right longitudinal bars disposed at the left side and the right side of the foldable bed frame respectively when the foldable bed frame is unfolded. In various embodiments, the left and right longitudinal bars are substantially the same as each other and parallel to each other when the foldable bed frame is unfolded. In many exemplary embodiments, each of the left and right longitudinal bars includes a first longitudinal bar and a second longitudinal bar pivotally connected to each other at their adjacent end portion. By way of example, FIG. 2A illustrates each of left and right longitudinal bars 10 having substantially identical first and second longitudinal bars 11. It should be noted that the first and second longitudinal bars can be but does not necessarily need to be the same as each other. For instance, the first and second longitudinal bars can be different from each other in length, width, or other features.

The exemplary foldable bed frame also includes a plurality of supporting assemblies, such as front, middle and rear supporting assemblies 3, coupled to the left and right longitudinal bars and supporting the left and right longitudinal bars when the foldable bed frame is unfolded. Front, middle and rear supporting assemblies 3 are disposed respectively at a front portion, a middle portion and a rear portion of the foldable bed frame when the foldable bed frame is unfolded.

In various exemplary embodiments, each of the front, middle and rear supporting assemblies includes a left vertical bar, a right vertical bar, a crossed bar pair, a left base and a right base. In some exemplary embodiments such as those illustrated in FIG. 2, left and right vertical bars 30 are substantially the same as each other or symmetric to each other with respect to a longitudinal vertical plane of the foldable bed frame. Left vertical bar 30 has an upper end portion and a lower end portion, with the upper end portion pivotally connected to left longitudinal bar 10 at a front portion, a middle portion, or a rear portion of the left longitudinal bar. Similarly, right vertical bar 30 has an upper end portion and a lower end portion, with the upper end portion pivotally connected to right longitudinal bar 10 at a front portion, a middle portion, or a rear portion of the right longitudinal bar.

The crossed bar pair includes a first crossed bar and a second crossed bar pivotally connected to each other at their middle portions. The first crossed bar has an upper end portion and a lower end portion, with the upper end portion pivotally connected to the upper end portion of the left vertical bar or pivotally connected to the left longitudinal bar at the front portion, the middle portion, or the rear portion of the left longitudinal bar. The second crossed bar has an upper end portion and a lower end portion, with the upper end portion pivotally connected to the upper end portion of the right vertical bar or pivotally connected to the right longitudinal bar at the front portion, the middle portion, or the rear portion of the right longitudinal bar. In some exemplary embodiments such as those illustrated in FIG. 2, the crossed bar pair 20 includes substantially the same first and second crossed bars 21.

In an exemplary embodiment, the upper end portions of the first and second crossed bars of the front supporting assembly are pivotally connected to the front portion of the left and right longitudinal bars. The upper end portions of the first and second crossed bars of the rear supporting assembly are pivotally connected to the rear portion of the left and right longitudinal bars. The upper end portions of the first and second crossed bars of the middle supporting assembly are pivotally connected to the upper end portions of the left and right vertical bars.

In some exemplary embodiments such as those illustrated in FIG. 2, left and right bases 40 are substantially the same as each other or symmetric to each other with respect to a longitudinal vertical plane of the foldable bed frame. Left base 40 is coupled to the lower end portion of the left vertical bar and the lower end portion of the second crossed bar when the foldable bed frame is unfolded. Right base 40 is coupled to the lower end portion of the right vertical bar and the lower end portion of the first crossed bar when the foldable bed frame is unfolded.

In some exemplary embodiments, base 40 includes a first slot such as first slot 41 for coupling with vertical bar 30 and a second slot such as second slot 42 for coupling with crossed bar 21. The coupling of the base with the vertical bar and the crossed bar can be either fixed or removable. In various exemplary embodiments, the base is fixedly coupled with one and removably coupled with the other of the two bars.

For instance, in some exemplary embodiments, of a respective supporting assembly in one or more of the front, middle and rear supporting assemblies, the left or right vertical bar is removably coupled to the first slot, and the first or second crossed bar is fixedly coupled to the second slot. In some exemplary embodiments, of a respective supporting assembly in one or more of the front, middle and rear supporting assemblies, the left or right vertical bar is fixed to the first slot, whereas the first or second crossed bar is removably coupled to the second slot. By way of example, FIGS. 2A-6 illustrate the left or right vertical bar of each supporting assembly removably coupled to the first slot and the first or second crossed bar of each supporting assembly fixedly coupled to the second slot.

In some exemplary embodiments, base 40 of the front or rear supporting assembly includes a bracket such as bracket 60 for coupling with the lower end portion of front or rear link 50. Bracket 60 can be formed at or attached to the base. In an exemplary embodiment, the bracket is attached (either fixedly or pivotally) to the base, and the lower end portion of front or rear link 50 is pivotally coupled to the bracket.

It should be noted that the bases of two supporting assemblies can be but does not necessarily need to be the same. It should also be noted that the left and right bases of the same supporting assembly can be but does not necessarily need to be the same. It should be further noted that the left or right base of the middle supporting assembly can be but does not necessarily need to be the same as the base of the front or rear supporting assembly (e.g., the left or right base of the middle supporting assembly does not necessarily need to have a bracket).

In various exemplary embodiments, the exemplary foldable bed frame further includes a plurality of links such as left and right front links, and left and right rear links 50. In some exemplary embodiments, each of the left and right front links has an upper end portion pivotally connected to the first longitudinal bar of the left or right longitudinal bar, and a lower end portion pivotally connected to the left or right base of the front supporting assembly. Similarly, each of the left and right rear links has an upper end portion pivotally connected to the second longitudinal bar of the left or right longitudinal bar, and a lower end portion pivotally connected to the left or right base of the rear supporting assembly. Like the first and second longitudinal bars, the left and right front links, and left and right rear links can be but does not necessarily need to be the same as each other.

In some exemplary embodiments, a respective supporting assembly in one or more of the front, middle and rear supporting assemblies further includes one or more guides such as guide 70 to guide relative movement of the vertical bars and the crossed bars. Guide 70 has a first end portion pivotally connected to the lower end portion of the left or right vertical bar 30 of the respective supporting assembly, and a second end portion pivotally connected to a lower middle portion of the first or second crossed bar 21 of the respective supporting assembly. As used herein, the term "lower middle portion" of a crossed bar refers to a portion of the crossed bar between the lower end and the crossed pivot point of the crossed bar. In an exemplary embodiment, each of the front, middle and rear supporting assemblies include a left guide and a right guide corresponding to the left and right vertical bars, respectively.

In some exemplary embodiments, guide 70 includes a first guiding piece and a second guiding piece disposed respectively on a front side and a rear side of the respective supporting assembly when the foldable bed frame is unfolded. Each of the first and second guiding pieces has a first end portion pivotally connected to the lower end portion of the left or right vertical bar of the respective supporting assembly, and a second end portion pivotally connected to a lower middle portion of the first or second crossed bar of the respective supporting assembly. The first and second guiding pieces can be the same as or different from each other. By way of illustrations, FIG. 2B illustrates two substantially the same guide pieces 71.

In some exemplary embodiments, foldable bed frame 2*a* further includes left and right connectors such as connector 12. The left connector pivotally connects the adjacent end portions of the first and second longitudinal bars of the left longitudinal bar. The right connector pivotally connects the adjacent end portions of the first and second longitudinal bars of the right longitudinal bar.

Figure 7:
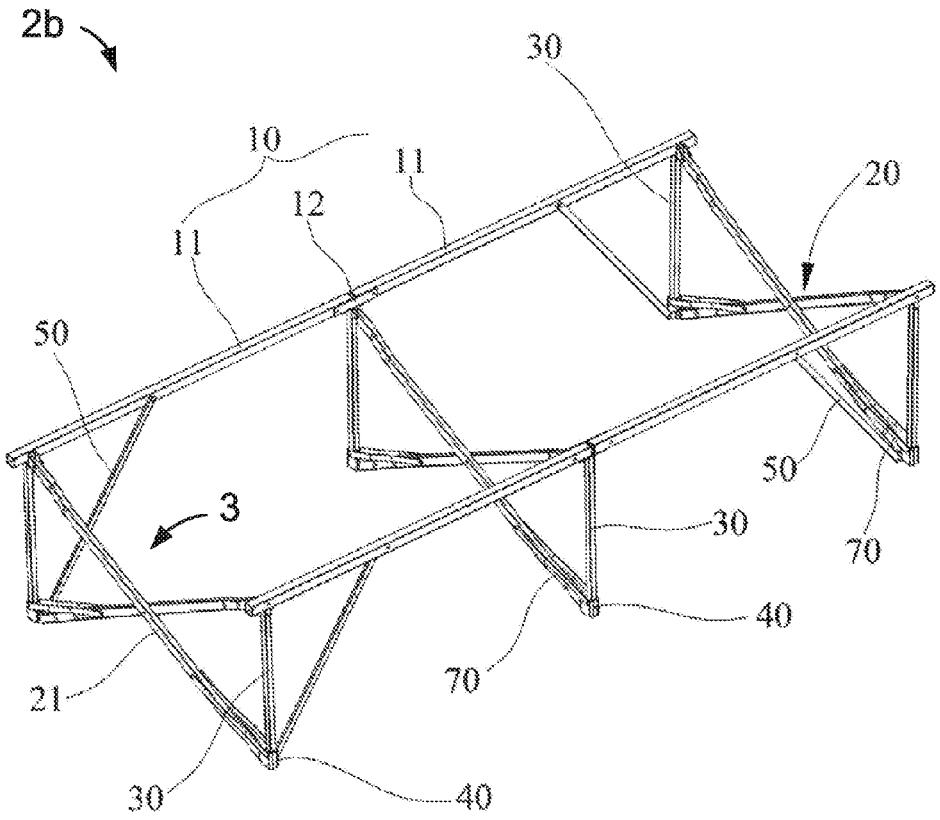
FIG. 7 is a schematic view illustrating an exemplary foldable bed frame including some alternative, additional or optional components in accordance with some exemplary embodiments of the present invention.
Figure 8A:
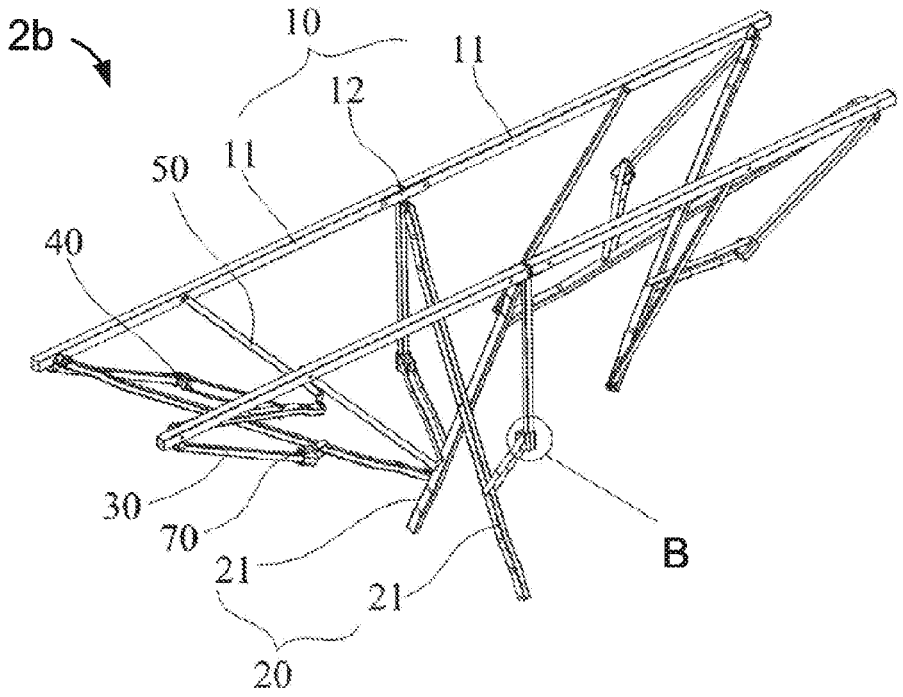
FIG. 8A is a schematic view illustrating the exemplary foldable bed frame of FIG. 7 in a partially folded state in accordance with some exemplary embodiments of the present invention.
Figure 8B:
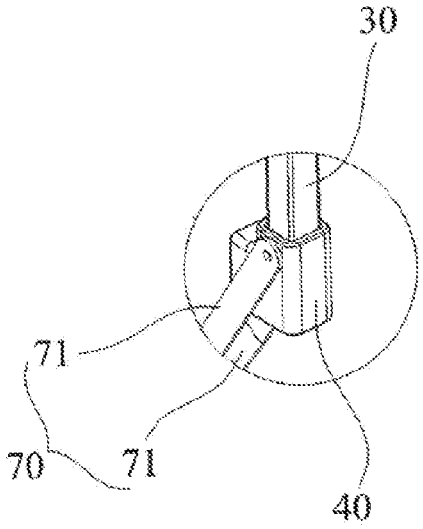
FIG. 8B is a partially enlarged view taken along circle B of FIG. 8A.

Foldable beds and bed frames of the present invention can include alternative, additional and/or optional components. As an example, FIGS. 7-8A illustrate exemplary foldable bed frame 2*b*, in which each of the front, middle and rear supporting assemblies has its left or right vertical bar fixedly (instead of removably) coupled to the first slot of base 40, and the first or second crossed bar removably (instead of fixedly) coupled to the second slot of base 40.

Figure 9A:
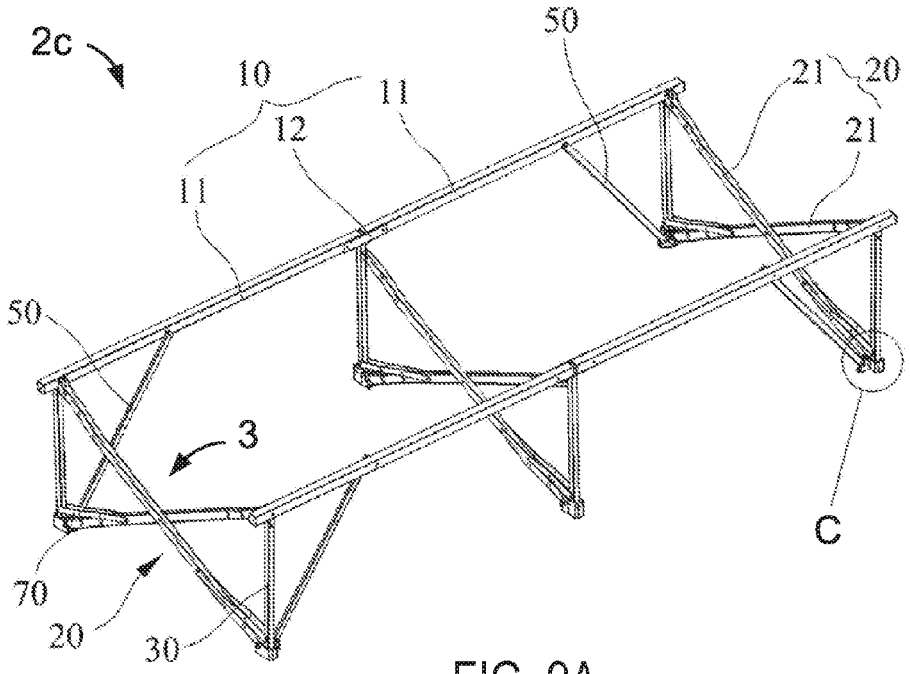
FIG. 9A is a schematic view illustrating an exemplary foldable bed frame including some alternative, additional or optional components in accordance with some exemplary embodiments of the present invention.
Figure 9B:
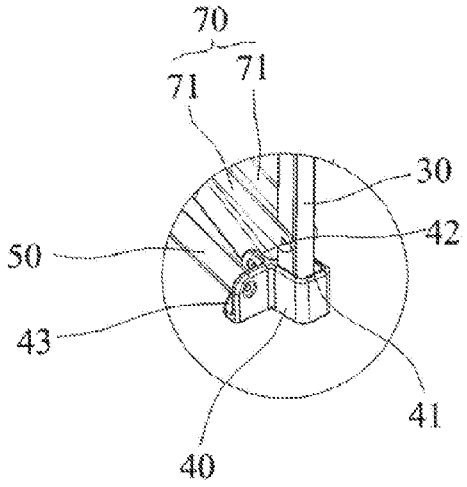
FIG. 9B is a partially enlarged view taken along circle C of FIG. 9A.
Figure 10:
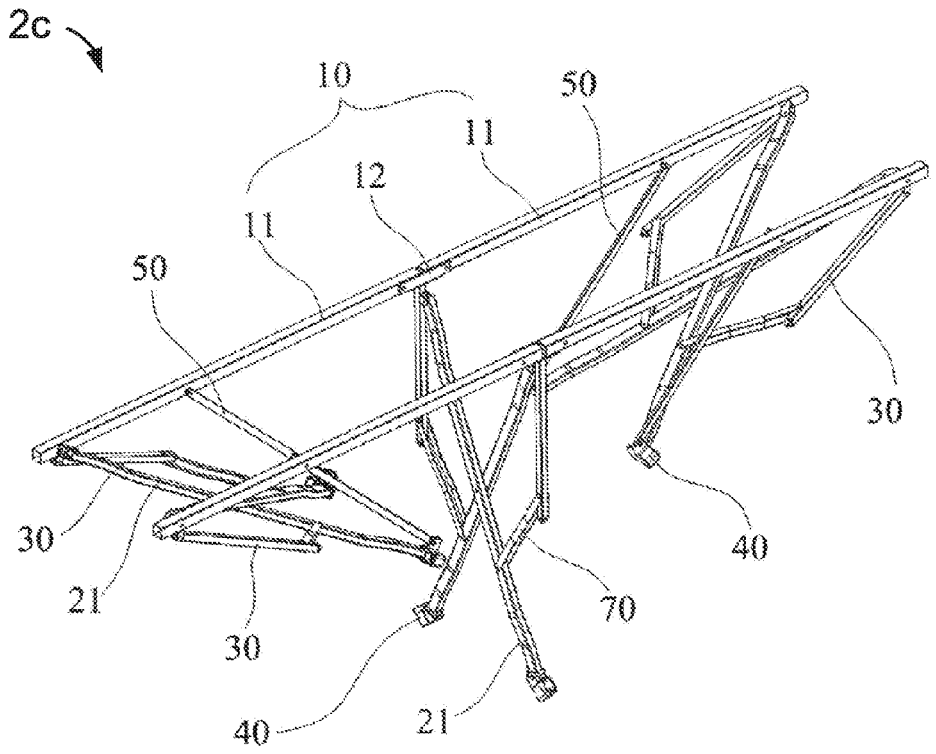
FIG. 10 is a schematic view illustrating the exemplary foldable bed frame of FIG. 9A in a partially folded state in accordance with some exemplary embodiments of the present invention.

As another example, FIGS. 9A-10 illustrate exemplary foldable bed frame 2*c*, in which one or more bases 40 do not include bracket 60 to couple with the lower end portion of link 50. Instead, in exemplary foldable bed frame 2*c*, base 40 of the front or rear supporting assembly includes a third slot such as third slot 43 to pivotally couple with the lower end portion of front or rear link 50.

Figure 11:
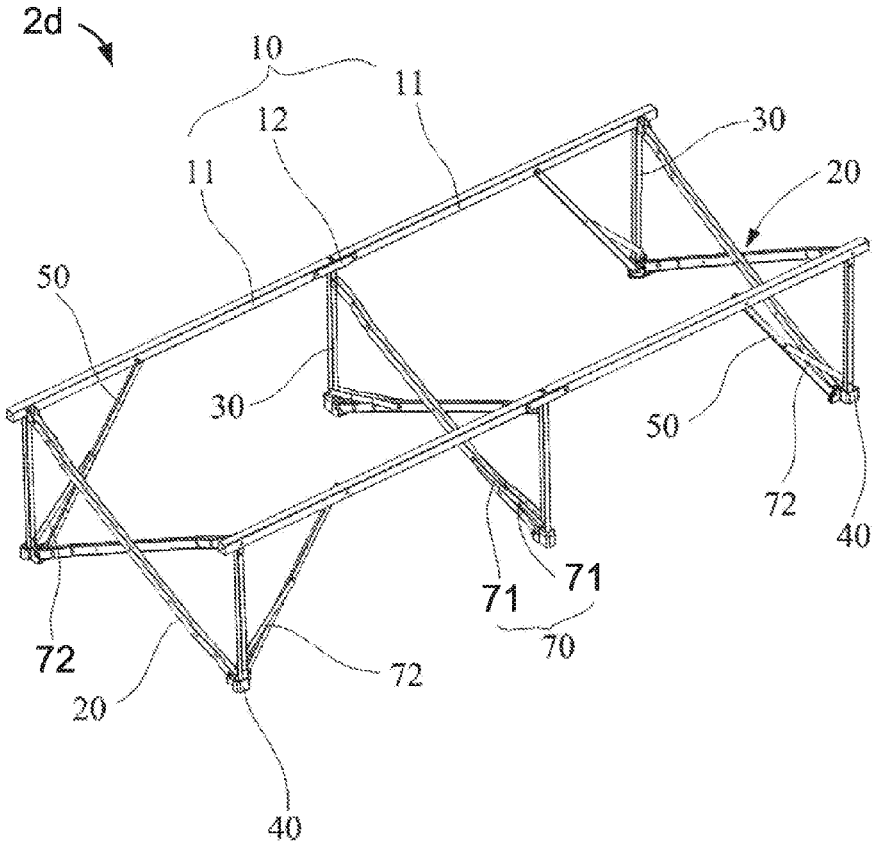
FIG. 11 is a schematic view illustrating an exemplary foldable bed frame including some alternative, additional or optional components in accordance with some exemplary embodiments of the present invention.
Figure 12:
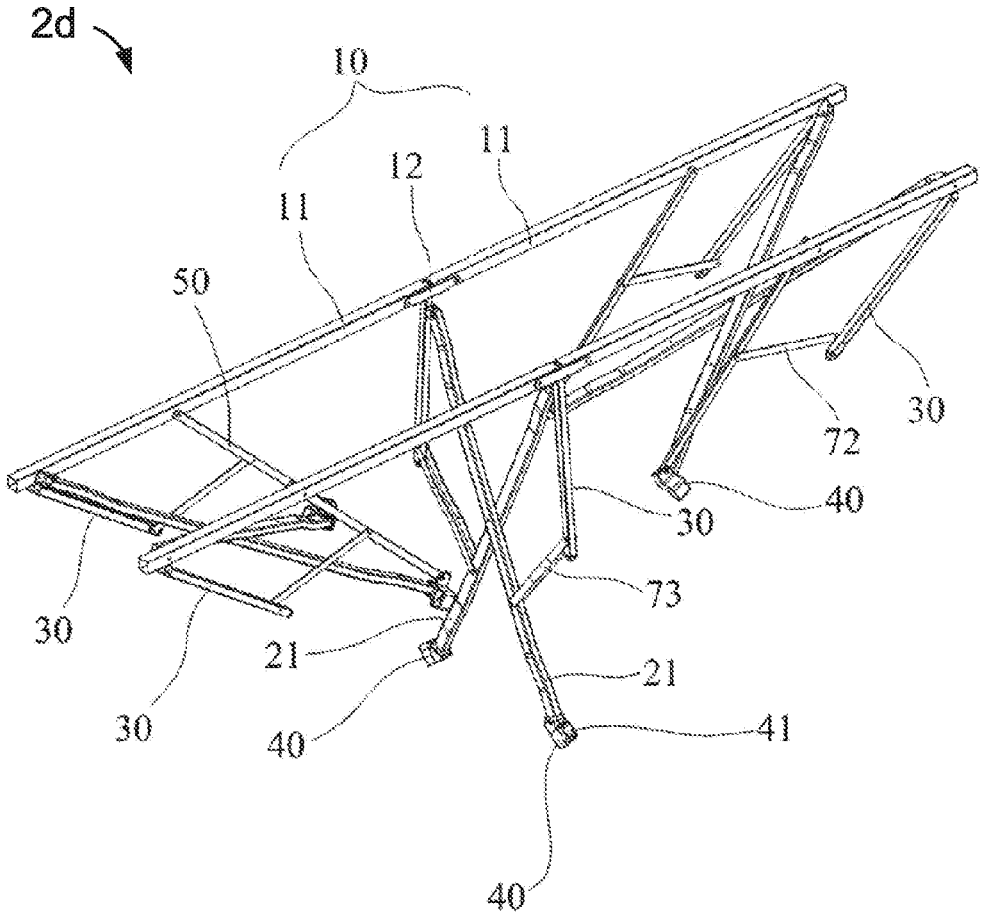
FIG. 12 is a schematic view illustrating the exemplary foldable bed frame of FIG. 11 in a partially folded state in accordance with some exemplary embodiments of the present invention.

As a further example, FIGS. 11-12 illustrates exemplary foldable bed frame 2*d*, in which the front or rear supporting assembly does not include guide 70. Instead, exemplary foldable bed frame 2*d* includes a front or rear guide connected to vertical bar 30 of the front or rear supporting assembly and front or rear link 50. In an exemplary embodiment, exemplary foldable bed frame 2*d* includes left and right front guides 72, each having a first end portion pivotally connected to the lower end portion of the left or right vertical bar of the front supporting assembly and a second end portion pivotally connected to a middle portion of the left or right front link. In an exemplary embodiment, exemplary foldable bed frame 2*d* includes left and right rear guides 72, each having a first end portion pivotally connected to the lower end portion of the left or right vertical bar of the rear supporting assembly and a second end portion pivotally connected to a middle portion of the left or right rear link. In some exemplary embodiments, exemplary foldable bed frame 2*d* includes left and right front guides as well as left and right rear guides.

It should be noted that the front guide can be but does not necessarily need to be the same as the rear guide. For example, the front guide can be different from the rear guide in length, width, or materials. By way of illustration, FIGS. 11 and 12 show substantially the same front and rear guides.

Figure 3:
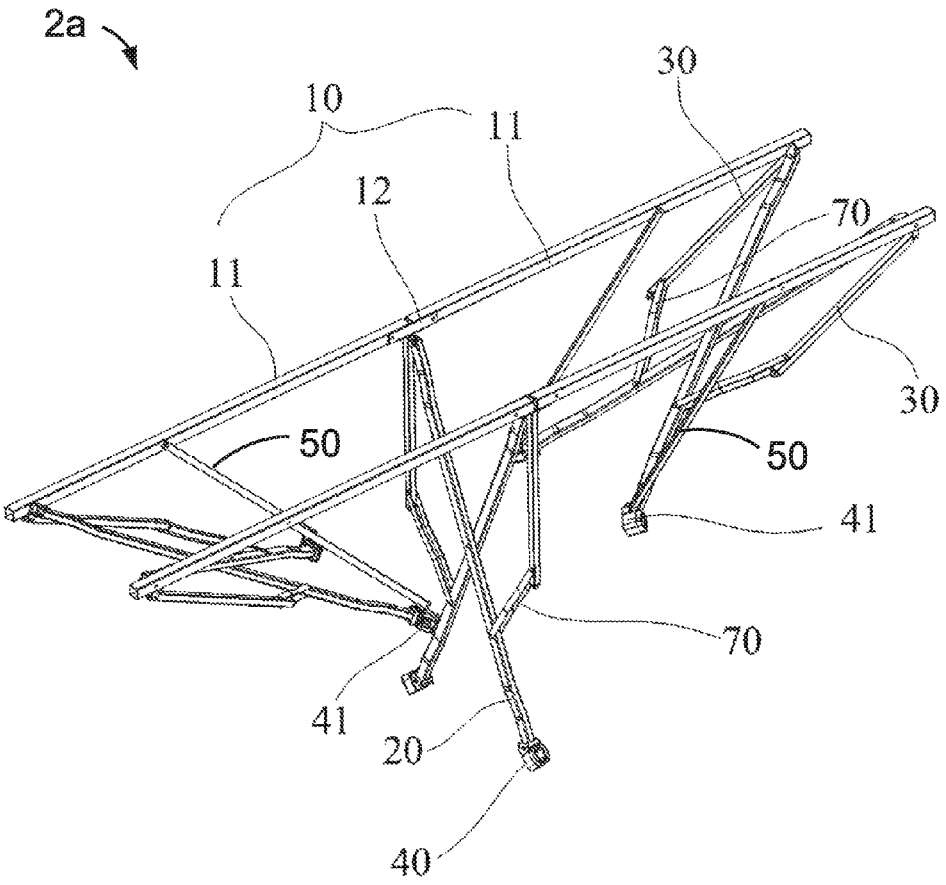
FIG. 3 is a schematic view illustrating the exemplary foldable bed frame of FIG. 2A in a first partially folded state in accordance with some exemplary embodiments of the present invention.
Figure 4:
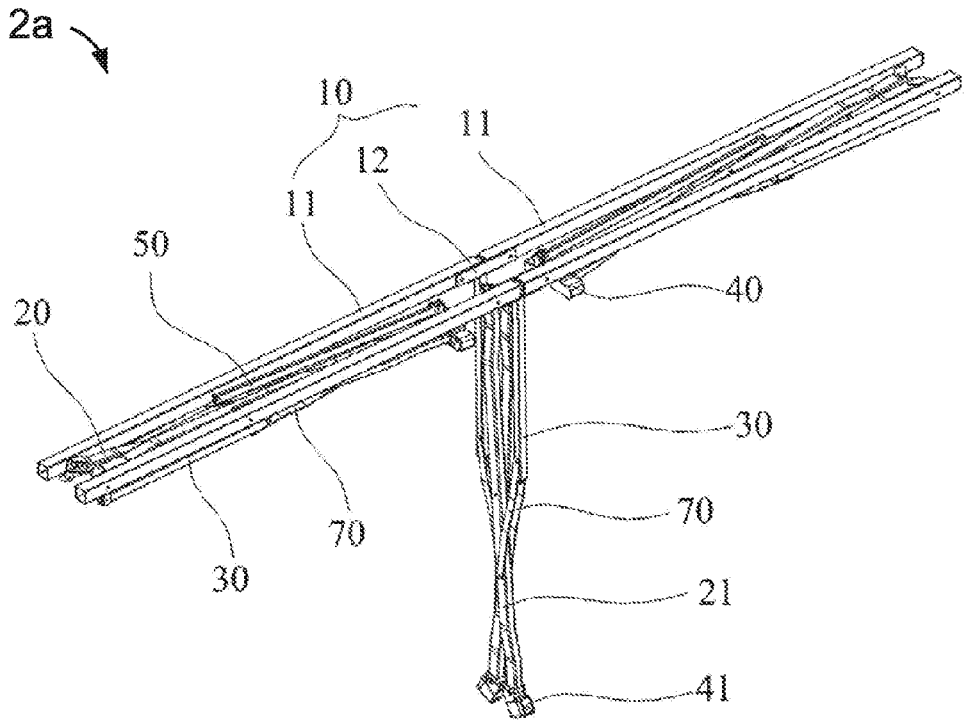
FIG. 4 is a schematic view illustrating the exemplary foldable bed frame of FIG. 2A in a second partially folded state in accordance with some exemplary embodiments of the present invention.
Figure 5:
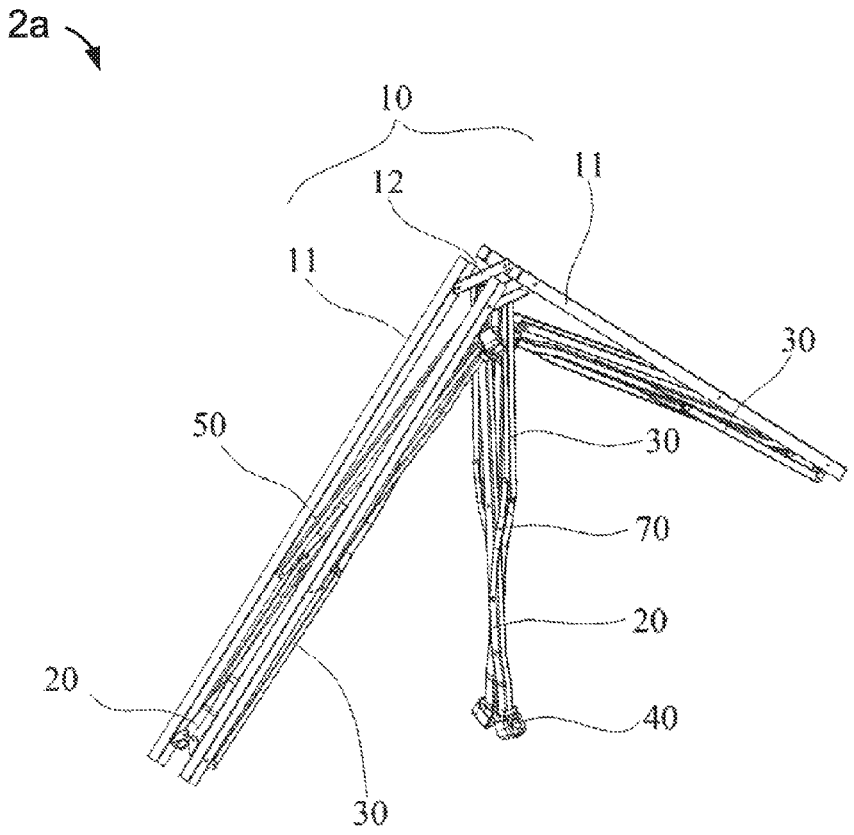
FIG. 5 is a schematic view illustrating the exemplary foldable bed frame of FIG. 2A in a third partially folded state in accordance with some exemplary embodiments of the present invention.
Figure 6:
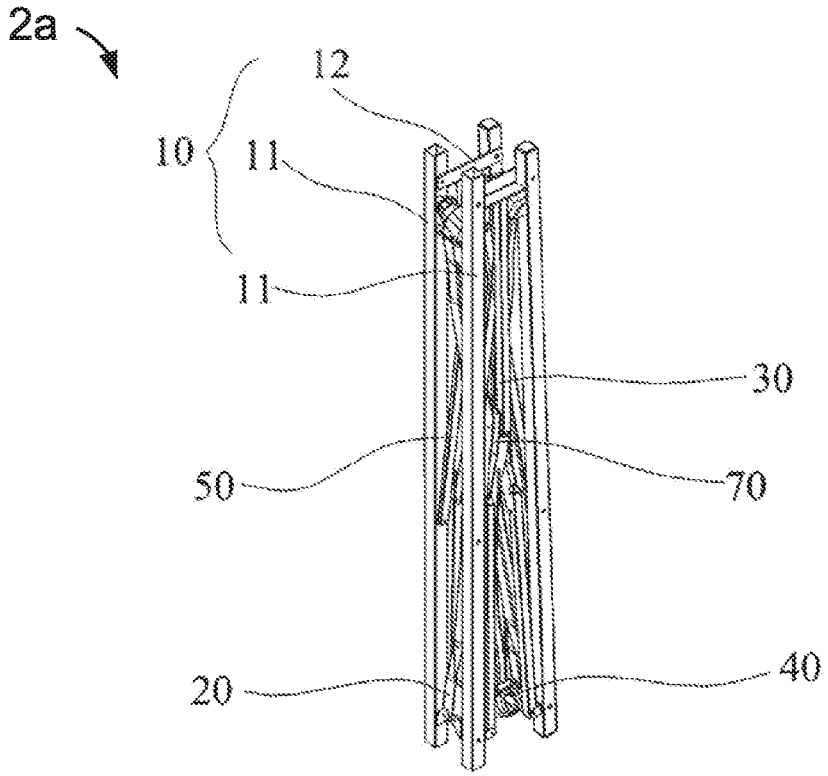
FIG. 6 is a schematic view illustrating the exemplary foldable bed frame of FIG. 2A in a folded state in accordance with some exemplary embodiments of the present invention.

Folding and unfolding the bed frames of the present invention is easy and convenient. For instance, to fold exemplary bed frame 2*a*, remove vertical bars 30 from first slots 41 of bases 40, and push left and right longitudinal bars 10 toward each other as illustrated in FIG. 3. As the left and right longitudinal bars move toward each other, the first and second crossed bars 21 of each crossed-bar pair 20 get closer to each other. Through front and rear links 50 and/or guides 70, the front and rear supporting assemblies are pulled (e.g., folded) toward left and right longitudinal bars 10. Eventually, the front and rear supporting assemblies are folded onto the left and right longitudinal bars as illustrated in FIG. 4. Afterwards, fold first and second longitudinal bars 11 (along with the front and rear supporting assemblies) toward the middle supporting assembly to complete the folding process. Reversing the folding process will unfold exemplary bed frame 2*a*. Similar processes can be used to fold and unfold other exemplary bed frames of the present invention, description of which are omitted to avoid redundancy.

As disclosed herein, the bed frames and beds of the present invention include supporting assemblies, each of which includes vertical and crossed bars. When the beds are unfolded and in use, the vertical bars support longitudinal bars and bear majority of the load. As such, the bed frames and beds of the present invention are stable and safe to use. The bed frames and beds of the present invention also include links and guides to facilitate easy folding and unfolding of the supporting assemblies. As such, the bed frames and beds of the present invention are convenient to use.

The terminology used herein is for the purpose of describing particular implementations only and is not intended to be limiting of the claims. As used in the description of the implementations and the appended claims, the singular forms "a", "an" and "the" are intended to include the plural forms as well, unless the context clearly indicates otherwise. It will be understood that the terms "left" and "right", "front" and "rear", "upper" and "lower", etc. are used to describe features of the exemplary embodiments with reference to the positions of such features as displayed in the figures. It will be understood that, although the terms "first," "second," etc. may be used herein to describe various elements, these elements should not be limited by these terms. These terms are only used to distinguish one element from another. For example, a first longitudinal bar could be termed a second longitudinal bar, and, similarly, a second longitudinal bar could be termed a first longitudinal bar, without changing the meaning of the description, so long as all occurrences of the "first longitudinal bar" are renamed consistently and all occurrences of the "second longitudinal bar" are renamed consistently.

What is claimed is:

1. A foldable bed frame comprising:

left and right longitudinal bars disposed respectively at a left side and a right side of the foldable bed frame when the foldable bed frame is unfolded, each of the left and right longitudinal bars comprising first and second longitudinal bars pivotally connected to each other at adjacent end portions thereof;

front, middle and rear supporting assemblies disposed respectively at a front portion, a middle portion and a rear portion of the foldable bed frame and supporting the left and right longitudinal bars when the foldable bed frame is unfolded, wherein each of the front, middle and rear supporting assemblies comprises:

a left vertical bar having a fixed length, an upper end portion and a lower end portion thereof, with the upper end portion thereof pivotally connected to the left longitudinal bar at a front portion, a middle portion, or a rear portion thereof;

a right vertical bar having a fixed length, an upper end portion and a lower end portion thereof, with the upper end portion thereof pivotally connected to the right longitudinal bar at a front portion, a middle portion, or a rear portion thereof;

a crossed bar pair comprising a first crossed bar and a second crossed bar pivotally connected to each other at middle portions thereof, wherein each of the first and second crossed bars has an upper end portion and a lower end portion;

the upper end portion of the first crossed bar is pivotally connected to the upper end portion of the left vertical bar or pivotally connected to the left longitudinal bar at the front portion, the middle portion, or the rear portion thereof; and the upper end portion of the second crossed bar is pivotally connected to the upper end portion of the right vertical bar or pivotally connected to the right longitudinal bar at the front portion, the middle portion, or the rear portion thereof;

a left base coupled to the lower end portion of the left vertical bar and the lower end portion of the second crossed bar when the foldable bed frame is unfolded; and a right base coupled to the lower end portion of the right vertical bar and the lower end portion of the first crossed bar when the foldable bed frame is unfolded;

left and right front links, each having an upper end portion and a lower end portion thereof, wherein the upper end portion of the left or right front link is pivotally connected to the first longitudinal bar of the left or right longitudinal bar, and the lower end portion of the left or right front link is pivotally connected to the left or right base of the front supporting assembly; and left and right rear links, each having an upper end portion and a lower end portion thereof, wherein the upper end portion of the left or right rear link is pivotally connected to the second longitudinal bar of the left or right longitudinal bar, and the lower end portion of the left or right rear link is pivotally connected to the left or right base of the rear supporting assembly.

2. The foldable bed frame of claim 1, wherein of a respective supporting assembly in one or more of the front, middle and rear supporting assemblies:

the left or right base includes a first slot and a second slot;

the left or right vertical bar is fixedly coupled to the first slot; and the first or second crossed bar is removably coupled to the second slot.

3. The foldable bed frame of claim 1, wherein of a respective supporting assembly in one or more of the front, middle and rear supporting assemblies:

the left or right base includes a first slot and a second slot;

the left or right vertical bar is removably coupled to the first slot; and the first or second crossed bar is fixedly coupled to the second slot.

4. The foldable bed frame of claim 1, wherein of a respective base in the left and right bases of the front and rear supporting assemblies:

a bracket is coupled to the respective base, or the respective base is formed with a third slot; and the link corresponding to the respective base is pivotally connected to the bracket or the third slot.

5. The foldable bed frame of claim 4, wherein the bracket is fixedly or pivotally coupled to the respective base.

6. The foldable bed frame of claim 1, wherein a respective supporting assembly in one or more of the front, middle and rear supporting assemblies further comprises:

one or more guides, each having a first end portion pivotally connected to the lower end portion of the left or right vertical bar of the respective supporting assembly, and a second end portion pivotally connected to a lower middle portion of the first or second crossed bar of the respective supporting assembly.

7. The foldable bed frame of claim 6, wherein:

a respective guide in the one or more guides comprises a first guiding piece and a second guiding piece disposed respectively on a front side and a rear side of the respective supporting assembly when the foldable bed frame is unfolded; and each of the first and second guiding pieces has a first end portion pivotally connected to the lower end portion of the left or right vertical bar of the respective supporting assembly, and a second end portion pivotally connected to a lower middle portion of the first or second crossed bar of the respective supporting assembly.

8. The foldable bed frame of claim 1, further comprising:

left and right front guides, each having a first end portion thereof pivotally connected to the lower end portion of the left or right vertical bar of the front supporting assembly and a second end portion thereof pivotally connected to a middle portion of the left or right front link.

9. The foldable bed frame of claim 1, further comprising:

left and right rear guides, each having a first end portion thereof pivotally connected to the lower end portion of the left or right vertical bar of the rear supporting assembly and a second end portion thereof pivotally connected to a middle portion of the left or right rear link.

10. The foldable bed frame of claim 1, further comprising:

left and right front guides, each having a first end portion thereof pivotally connected to the lower end portion of the left or right vertical bar of the front supporting assembly and a second end portion thereof pivotally connected to a middle portion of the left or right front link; and left and right rear guides, each having a first end portion thereof pivotally connected to the lower end portion of the left or right vertical bar of the rear supporting assembly and a second end portion thereof pivotally connected to a middle portion of the left or right rear link, wherein the middle supporting assembly further comprises one or more guides, wherein a respective guide in the one or more guides comprises a first guiding piece and a second guiding piece disposed respectively on a front side and a rear side of the respective supporting assembly when the foldable bed frame is unfolded; and each of the first and second guiding pieces has a first end portion pivotally connected to the lower end portion of the left or right vertical bar of the respective supporting assembly, and a second end portion pivotally connected to a lower middle portion of the first or second crossed bar of the respective supporting assembly.

11. The foldable bed frame of claim 1, further comprising:

a left connector pivotally connecting the adjacent end portions of the first and second longitudinal bars of the left longitudinal bar; and a right connector pivotally connecting the adjacent end portions of the first and second longitudinal bars of the right longitudinal bar.

12. A foldable bed comprising:

a bedding; and the foldable bed frame of claim 1 to support the bedding.

13. The foldable bed of claim 12, wherein of a respective supporting assembly in one or more of the front, middle and rear supporting assemblies:

the left or right base includes a first slot and a second slot;

the left or right vertical bar is fixedly coupled to the first slot; and the first or second crossed bar is removably coupled to the second slot.

14. The foldable bed of claim 12, wherein of a respective supporting assembly in one or more of the front, middle and rear supporting assemblies:

the left or right base includes a first slot and a second slot;

the left or right vertical bar is removably coupled to the first slot; and the first or second crossed bar is fixedly coupled to the second slot.

15. The foldable bed of claim 12, wherein of a respective base in the left and right bases of the front and rear supporting assemblies:

a bracket is coupled to the respective base, or the respective base is formed with a third slot; and the link corresponding to the respective base is pivotally connected to the bracket or the third slot.

16. The foldable bed of claim 12, wherein a respective supporting assembly in one or more of the front, middle and rear supporting assemblies further comprises:

one or more guides, each having a first end portion pivotally connected to the lower end portion of the left or right vertical bar of the respective supporting assembly, and a second end portion pivotally connected to a lower middle portion of the first or second crossed bar of the respective supporting assembly.

17. The foldable bed of claim 16, wherein:

a respective guide in the one or more guides comprises a first guiding piece and a second guiding piece disposed respectively on a front side and a rear side of the respective supporting assembly when the foldable bed frame is unfolded; and each of the first and second guiding pieces has a first end portion pivotally connected to the lower end portion of the left or right vertical bar of the respective supporting assembly, and a second end portion pivotally connected to a lower middle portion of the first or second crossed bar of the respective supporting assembly.

18. The foldable bed of claim 12, further comprising:

left and right front guides, each having a first end portion thereof pivotally connected to the lower end portion of the left or right vertical bar of the front supporting assembly and a second end portion thereof pivotally connected to a middle portion of the left or right front link; and left and right rear guides, each having a first end portion thereof pivotally connected to the lower end portion of the left or right vertical bar of the rear supporting assembly and a second end portion thereof pivotally connected to a middle portion of the left or right rear link.

19. The foldable bed of claim 12, further comprising:

left and right front guides, each having a first end portion thereof pivotally connected to the lower end portion of the left or right vertical bar of the front supporting assembly and a second end portion thereof pivotally connected to a middle portion of the left or right front link; and left and right rear guides, each having a first end portion thereof pivotally connected to the lower end portion of the left or right vertical bar of the rear supporting assembly and a second end portion thereof pivotally connected to a middle portion of the left or right rear link, wherein the middle supporting assembly further comprises one or more guides, wherein a respective guide in the one or more guides comprises a first guiding piece and a second guiding piece disposed respectively on a front side and a rear side of the respective supporting assembly when the foldable bed frame is unfolded; and each of the first and second guiding pieces has a first end portion pivotally connected to the lower end portion of the left or right vertical bar of the respective supporting assembly, and a second end portion pivotally connected to a lower middle portion of the first or second crossed bar of the respective supporting assembly.

20. The foldable bed of claim 12, further comprising:

a left connector pivotally connecting the adjacent end portions of the first and second longitudinal bars of the left longitudinal bar; and a right connector pivotally connecting the adjacent end portions of the first and second longitudinal bars of the right longitudinal bar.

21. A foldable bed frame comprising:

left and right longitudinal bars disposed respectively at a left side and a right side of the foldable bed frame when the foldable bed frame is unfolded, each of the left and right longitudinal bars comprising first and second longitudinal bars pivotally connected to each other at adjacent end portions thereof;

front, middle and rear supporting assemblies disposed respectively at a front portion, a middle portion and a rear portion of the foldable bed frame and supporting the left and right longitudinal bars when the foldable bed frame is unfolded, wherein each of the front, middle and rear supporting assemblies comprises:

a left vertical bar having an upper end portion and a lower end portion thereof, with the upper end portion thereof pivotally connected to the left longitudinal bar at a front portion, a middle portion, or a rear portion thereof;

a right vertical bar having an upper end portion and a lower end portion thereof, with the upper end portion thereof pivotally connected to the right longitudinal bar at a front portion, a middle portion, or a rear portion thereof;

a crossed bar pair comprising a first crossed bar and a second crossed bar pivotally connected to each other at middle portions thereof, wherein each of the first and second crossed bars has an upper end portion and a lower end portion;

the upper end portion of the first crossed bar is pivotally connected to the upper end portion of the left vertical bar or pivotally connected to the left longitudinal bar at the front portion, the middle portion, or the rear portion thereof; and the upper end portion of the second crossed bar is pivotally connected to the upper end portion of the right vertical bar or pivotally connected to the right longitudinal bar at the front portion, the middle portion, or the rear portion thereof;

a left base coupled to the lower end portion of the left vertical bar and the lower end portion of the second crossed bar when the foldable bed frame is unfolded; and a right base coupled to the lower end portion of the right vertical bar and the lower end portion of the first crossed bar when the foldable bed frame is unfolded;

left and right front links, each having an upper end portion and a lower end portion thereof, wherein the upper end portion of the left or right front link is pivotally connected to the first longitudinal bar at a position between the front supporting assembly and the middle supporting assembly of the left or right longitudinal bar, and the lower end portion of the left or right front link is pivotally connected to the left or right base of the front supporting assembly; and left and right rear links, each having an upper end portion and a lower end portion thereof, wherein the upper end portion of the left or right rear link is pivotally connected to the second longitudinal bar at a position between the middle supporting assembly and the rear supporting assembly of the left or right longitudinal bar, and the lower end portion of the left or right rear link is pivotally connected to the left or right base of the rear supporting assembly.

* * * * *